US007443406B2

(12) United States Patent
Mohri

(10) Patent No.: US 7,443,406 B2
(45) Date of Patent: Oct. 28, 2008

(54) TANDEM IMAGE FORMING APPARATUS

(75) Inventor: Kazuo Mohri, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 196 days.

(21) Appl. No.: 11/276,304

(22) Filed: Feb. 23, 2006

(65) Prior Publication Data

US 2006/0197825 A1 Sep. 7, 2006

(30) Foreign Application Priority Data

Mar. 4, 2005 (JP) ..... 2005-060981
Mar. 30, 2005 (JP) ..... 2005-098236

(51) Int. Cl.
*B41J 2/385* (2006.01)

(52) U.S. Cl. ..... 347/115

(58) Field of Classification Search ..... None
See application file for complete search history.

(56) References Cited

U.S. PATENT DOCUMENTS 6,449,451 B2 * 9/2002 Tsuruya et al. ..... 399/223
6,498,905 B1 * 12/2002 Tsuruya ..... 399/12
7,296,870 B2 * 11/2007 Tyson et al. ..... 347/19
2004/0085386 A1 * 5/2004 Yamamura ..... 347/19

FOREIGN PATENT DOCUMENTS

| | | |
|---|---|---|
| JP | 5-35042 | 2/1993 |
| JP | 2729094 | 12/1997 |
| JP | 10-171199 | 6/1998 |
| JP | 2001-83862 | 3/2001 |
| JP | 2001-183886 | 7/2001 |
| JP | 2002-14508 | 1/2002 |

* cited by examiner

*Primary Examiner*—Matthew Luu
*Assistant Examiner*—Justin Seo
(74) *Attorney, Agent, or Firm*—Oblon, Spivak, McClelland, Maier & Neustadt P.C.

(57) ABSTRACT

An image forming apparatus includes image-forming process cartridges arranged in tandem; a color-information acquiring unit configured to acquire color information representing a color of an image to be formed by each of the image-forming process cartridges; an image-information distributing unit configured to distribute print information for the color to an image-forming process cartridge that forms an image of the color; a designating unit configured to designate a print mode that includes a monochromatic mode and a full-color mode; a control unit configured to control image forming operation by the image-forming process cartridges to perform a print operation in designated print mode; and an alarming unit configured to generate an alarm for designation for the full-color mode when the color is identical in two or more image-forming process cartridges.

15 Claims, 10 Drawing Sheets

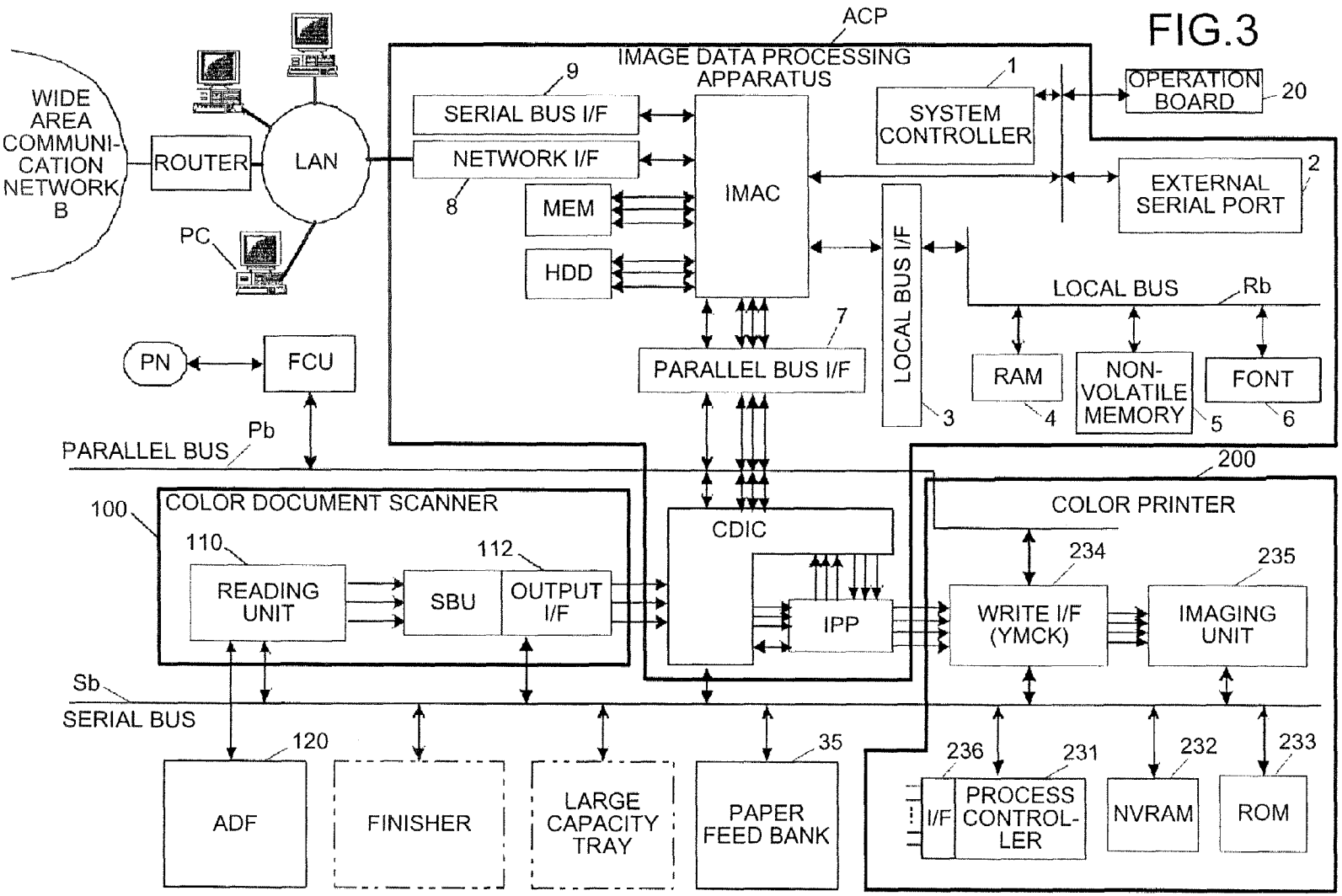
FIG.3
OPERATION BOARD
20
EXTERNAL SERIAL PORT
2
SYSTEM CONTROLLER
1
LOCAL BUS
Rb
FONT
6
NON-VOLATILE MEMORY
5
RAM
4
LOCAL BUS I/F
3
ACP
IMAGE DATA PROCESSING APPARATUS
IMAC
PARALLEL BUS I/F
7
SERIAL BUS I/F
9
NETWORK I/F
8
MEM
HDD
LAN
ROUTER
PC
WIDE AREA COMMUNI-CATION NETWORK B
FCU
PN
Pb
PARALLEL BUS
COLOR PRINTER
200
IMAGING UNIT
235
WRITE I/F (YMCK)
234
PROCESS CONTROL-LER
231
I/F
236
ROM
233
NVRAM
232
CDIC
IPP
COLOR DOCUMENT SCANNER
100
OUTPUT I/F
112
SBU
READING UNIT
110
PAPER FEED BANK
35
LARGE CAPACITY TRAY
FINISHER
ADF
120
Sb
SERIAL BUS

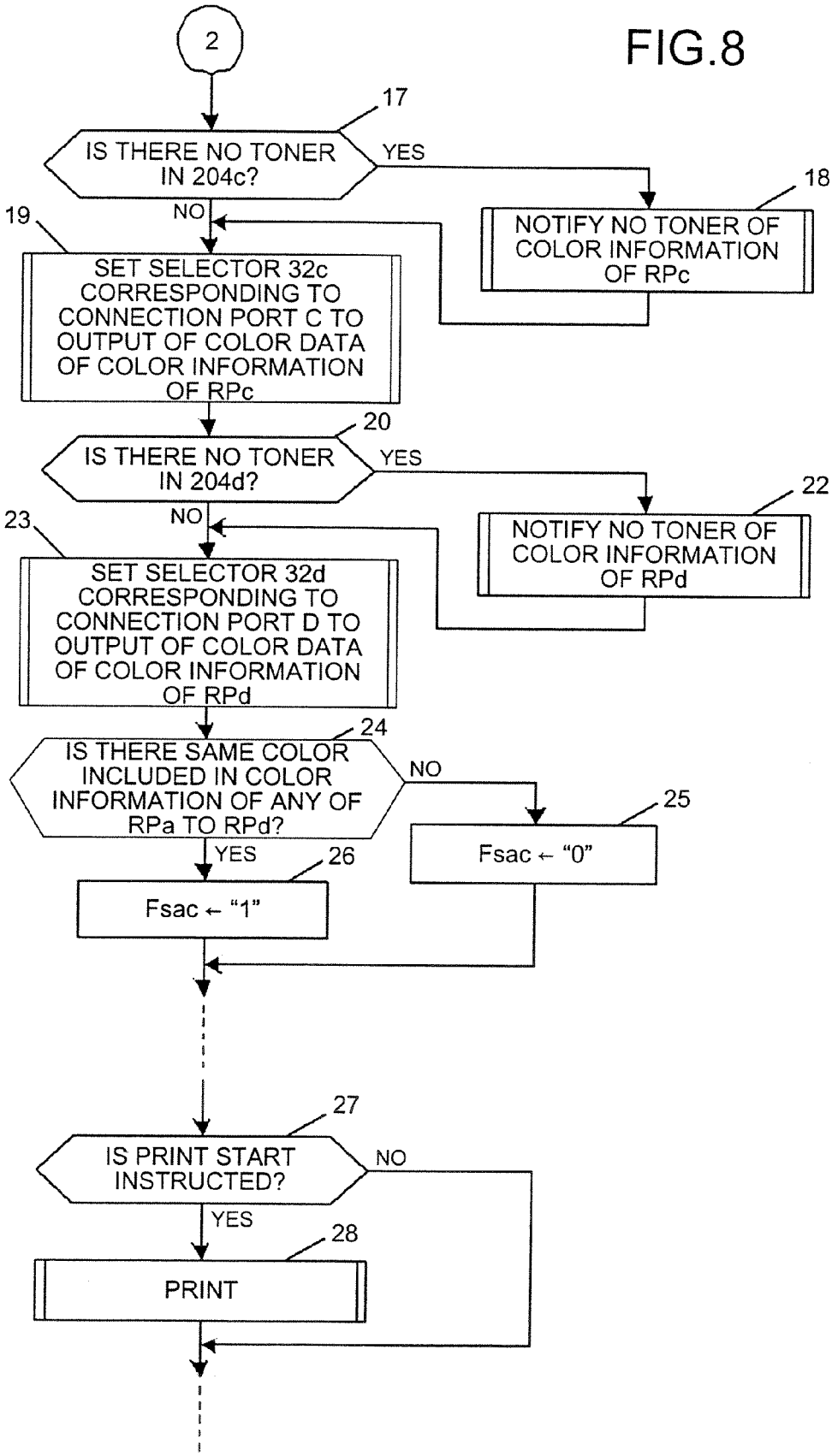
FIG.8
2
17
IS THERE NO TONER IN 204c?
YES
NO
18
NOTIFY NO TONER OF COLOR INFORMATION OF RPc
19
SET SELECTOR 32c CORRESPONDING TO CONNECTION PORT C TO OUTPUT OF COLOR DATA OF COLOR INFORMATION OF RPc
20
IS THERE NO TONER IN 204d?
YES
NO
22
NOTIFY NO TONER OF COLOR INFORMATION OF RPd
23
SET SELECTOR 32d CORRESPONDING TO CONNECTION PORT D TO OUTPUT OF COLOR DATA OF COLOR INFORMATION OF RPd
24
IS THERE SAME COLOR INCLUDED IN COLOR INFORMATION OF ANY OF RPa TO RPd?
NO
YES
25
Fsac ← "0"
26
Fsac ← "1"
27
IS PRINT START INSTRUCTED?
NO
YES
28
PRINT

TANDEM IMAGE FORMING APPARATUS

CROSS-REFERENCE TO RELATED APPLICATIONS

The present document incorporates by reference the entire contents of Japanese priority document, 2005-060981 filed in Japan on Mar. 4, 2005 and 2005-098236 filed in Japan on Mar. 30, 2005.

BACKGROUND OF THE INVENTION

1. Field of the Invention

The present invention relates to an image forming apparatus that includes image-forming process cartridges arranged in tandem.

2. Description of the Related Art

Japanese Patent Application Laid-open No. H5-35042 discloses a color image forming apparatus including image-forming process cartridges arranged in tandem along a paper feed line and installable in an arbitrary order.

Japanese Patent Application Laid-open No. H10-171199 discloses a color electrophotographic apparatus that includes image-forming process cartridges each of which has a color identifying unit, arranged in tandem along a paper feed line. The color identifying unit identifies the color of the toner contained in the cartridge, and detects whether each cartridge is placed in a proper position, and displays a result of detection.

Japanese Patent Application Laid-open No. 2001-83862 discloses an image forming apparatus that includes a common image-forming process cartridges each of which has a memory unit, arranged in tandem along a paper feed line. The memory unit stores the color of the toner contained in the cartridge, and when each image-forming process cartridge containing each color is not positioned properly, the image forming apparatus does not start operation, or alarms the improper condition.

Japanese Patent Application Laid-open No. 2001-183886 discloses an image forming apparatus that includes image-forming process cartridges arranged in tandem along a paper feed line. An image-forming process cartridge of black is arranged upstream to other image-forming process cartridges in a direction of the paper feed line, and a toner retaining capacity thereof is expanded by stretching toward the upstream side.

Japanese Patent Application Laid-open No. 2002-14508 discloses an image forming apparatus that includes image-forming process cartridges arranged in tandem along the moving path of an intermediate transfer belt, that detects toner color information of the image-forming process cartridges installed in the respective positions, and that selectively supplies image data of the toner color detected to a print head at each installation position. Each image formed by each image-forming process cartridge is transferred onto the intermediate transfer belt from which the image is transferred onto paper.

Conventionally, various image forming apparatuses for forming a multicolor (two or more colors) image using, for example, an electrophotographic process are developed and are put to a practical use. The following is a technique common to those apparatuses. There are color toners of black (Bk), yellow (Y), magenta (M), and cyan (C). The position and the order in the tandem arrangement of developing units or image-forming units of the respective color toners are fixed, and the number of color toners to be used is also fixed for each apparatus. In other words, the apparatuses cannot be used in a condition appropriate for use desired by each user. Therefore the user needs to purchase another appropriate apparatus. For example, with a color copying machine, there are many inconveniences, such as the use of the color copying machine as a two-color fast copying machine of black and white, the use of a full-color developing unit for a two-color document (red and white, yellow and blue, black and yellow, etc.), the user being unable to build up own system by purchasing an optional unit (the system being fixed on colors), and the need for a maintenance even for unused colors. That is, specifications and functions have not been able to be customized for user.

To cope with the problems, the above conventional image forming apparatuses have been proposed. However, the ordinary tandem color image forming apparatus has limitations, such as the use of detachable transfer units in such a way as not to drive color cartridges (Y, M, C) in consideration of the life elongation in case of printing only in black, and the deposition of the process cartridge of black (Bk) in the farthest position so as not to affect the connection/disconnection of the transfer units in consideration of productivity. If the order in the tandem arrangement is set free as the technologies described in Japanese Patent Application Laid-open Nos. H5-35042 and 2002-14508, it becomes necessary to configure the apparatus such that all of the transfer units at image-forming process cartridge installation positions are individually detachable, and to provide, at any position, an enough space for the image-forming process cartridge of black Bk, which has a large-capacity toner container. Thus, size and cost of the image forming apparatus increase.

SUMMARY OF THE INVENTION

It is an object of the present invention to at least solve the problems in the conventional technology.

An image forming apparatus according to one aspect of the present invention includes a plurality of image-forming process cartridges arranged in tandem; a color-information acquiring unit configured to acquire color information representing a color of an image to be formed by each of the image-forming process cartridges; an image-information distributing unit configured to distribute print information for the color to an image-forming process cartridge that forms an image of the color; a designating unit configured to designate a print mode that includes a monochromatic mode and a full-color mode; a control unit configured to control image forming operation by the image-forming process cartridges to perform a print operation in designated print mode; and an alarming unit configured to generate an alarm for designation for the full-color mode when the color is identical in two or more image-forming process cartridges.

An image forming apparatus according to another aspect of the present invention includes a plurality of image-forming process cartridges arranged in tandem; a color-information acquiring unit configured to acquire color information representing a color of an image to be formed by each of the image-forming process cartridges; an image-information distributing unit configured to distribute print information for the color to an image-forming process cartridge that forms an image of the color; a designating unit configured to designate a print mode that includes a monochromatic mode and a full-color mode; a control unit configured to control image forming operation by the image-forming process cartridges to perform a print operation in designated print mode; an alarming unit configured to generate an alarm for designation for the full-color mode when the color is identical in two or more image-forming process cartridges; and a data processing unit configured to convert document information transmitted from an external device into print information of each color that is compatible to the image forming apparatus to output to the image forming apparatus.

An image forming apparatus according to still another aspect of the present invention includes a plurality of image-forming process cartridges arranged in tandem; a color-information acquiring unit configured to acquire color information representing a color of an image to be formed by each of the image-forming process cartridges; an image-information distributing unit configured to distribute print information for the color to an image-forming process cartridge that forms an image of the color; a designating unit configured to designate a print mode that includes a monochromatic mode and a full-color mode; a control unit configured to control image forming operation by the image-forming process cartridges to perform a print operation in designated print mode; an alarming unit configured to generate an alarm for designation for the full-color mode when the color is identical in two or more image-forming process cartridges; a document reading unit configured to read an image of a document, and to generate image data representing the image; and a data processing unit configured to convert generated image data into print information of each color that is compatible to the image forming apparatus to output to the image forming apparatus.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 3 is a block diagram of an image processing system of a copying machine shown in FIG. 1;

FIG. 8 is a flowchart of another part of the imaging process control by the process controller;

DETAILED DESCRIPTION OF THE PREFERRED EMBODIMENTS

Exemplary embodiments according to the present invention will be explained in detail with reference to the accompanying drawings.

Figure 1:
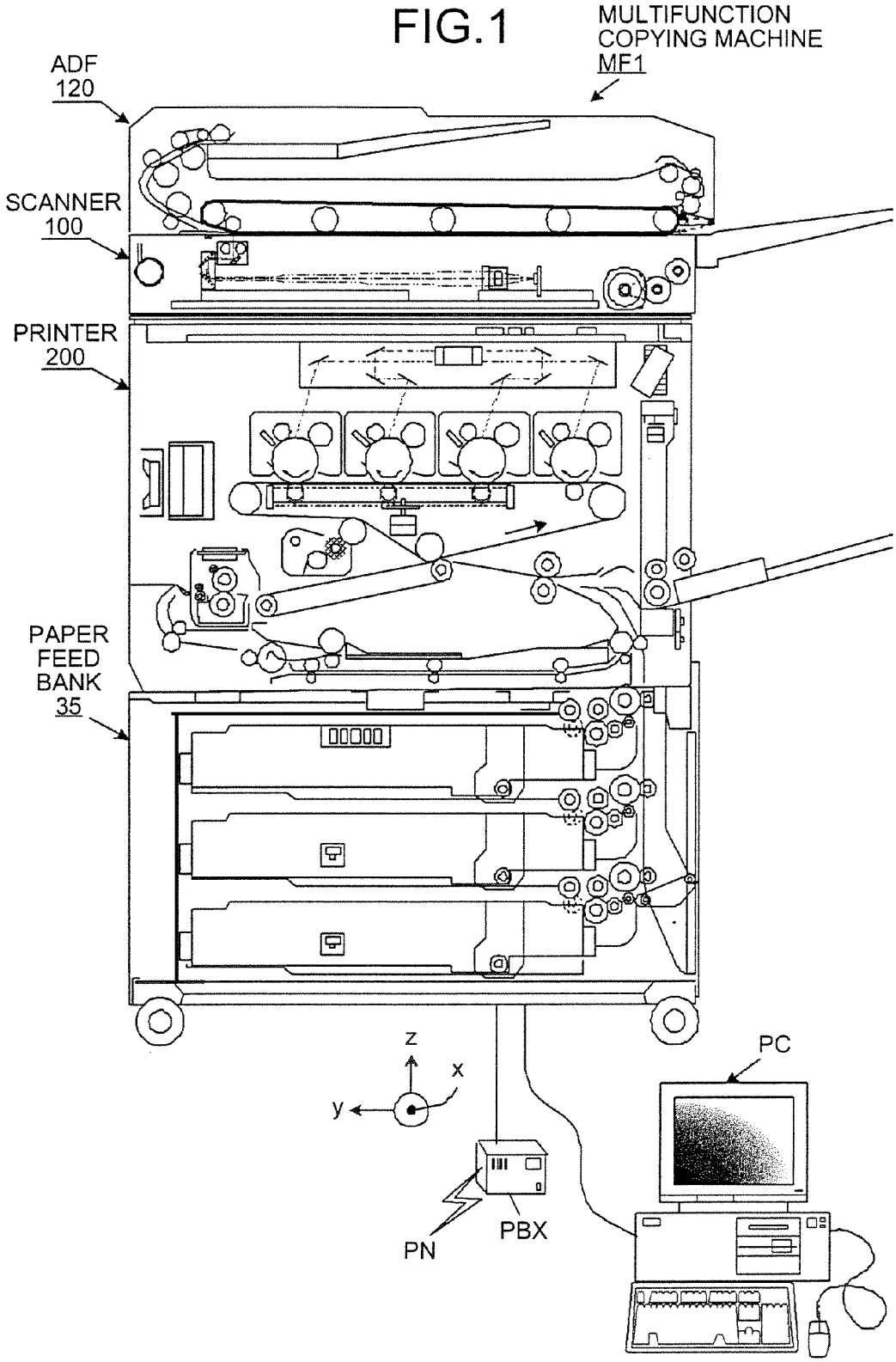
FIG. 1 is a schematic of a multifunction full-color copying machine according to a first embodiment of the present invention.

FIG. 1 depicts a multifunction full-color digital copying machine MF1 according to a first embodiment of the present invention. The full-color copying machine MF1 generally includes an auto document feeder (ADF) 120, an operation board 20, a color scanner 100, a color printer 200, and a paper feed bank 35. A local area network (LAN) to which a personal computer PC is connected is connected to an image data processing apparatus ACP shown in FIG. 3 in the copying machine. A facsimile controller FCU shown in FIG. 3 in the copying machine can perform facsimile communication via a branch exchange PBX and a public communication network PN.

Figure 2:
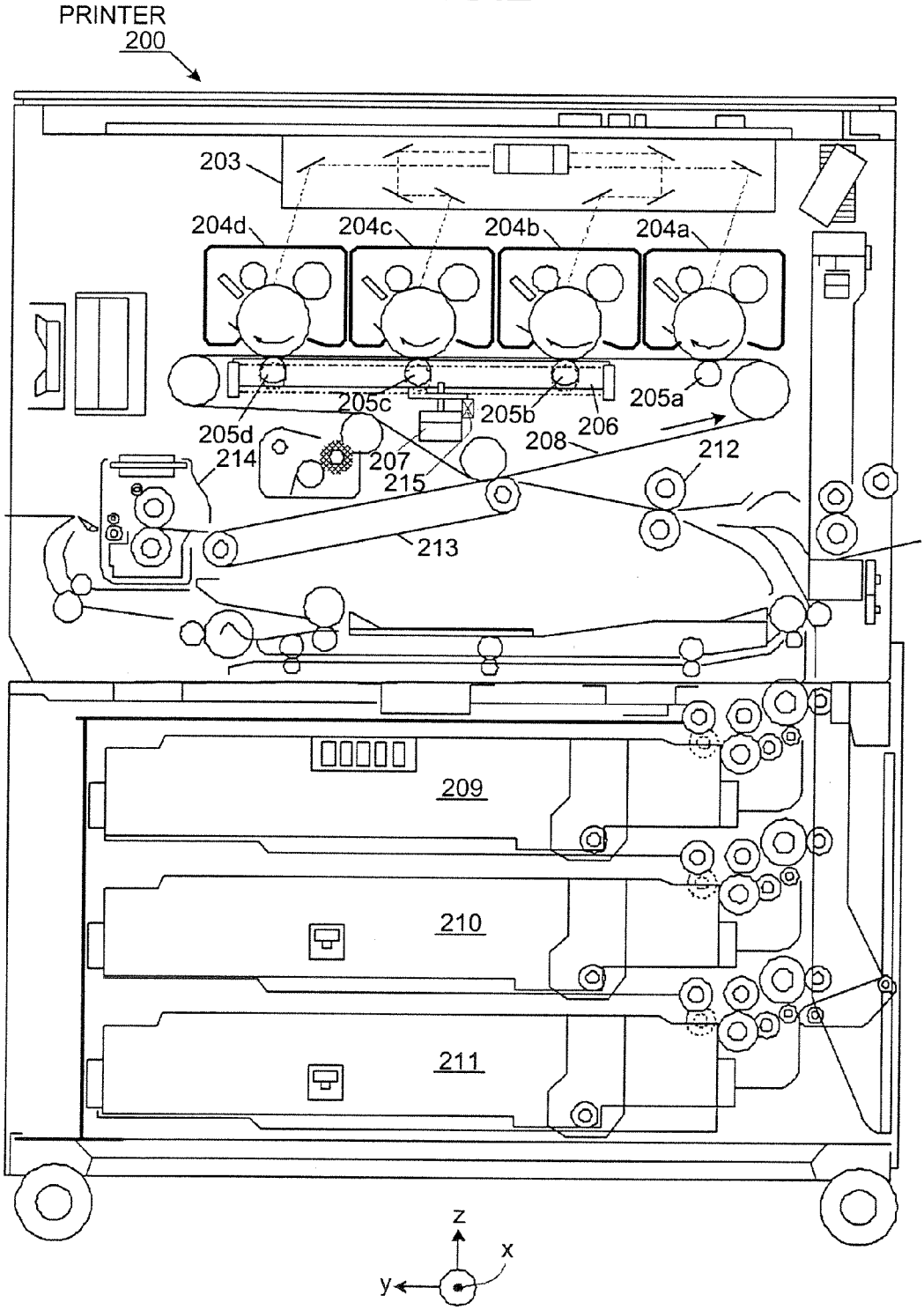
FIG. 2 is a cross-section of an image-forming mechanism of a printer shown in FIG. 1.

FIG. 2 depicts an outline of an image-forming mechanism of the printer 200 shown in FIG. 1. The printer 200 includes transfer units each of which has an endless transfer belt 208. The transfer belt 208 is stretched over three support rollers and one tension roller, and is rotated counterclockwise. A transfer-body cleaning unit that removes a residual toner remaining on the transfer belt 208 after image transfer is located near the tension roller.

Process cartridges 204*a* to 204*d* are equipped on the transfer belt 208 between one support roller and another support roller along the moving direction of the transfer belt 208. Transfer rollers 205*a* to 205*d* are arranged to face photoconductive drums respectively retained in the process cartridges 204*a* to 204*d* with the transfer belt 208 in between. Each of the process cartridges 204*a* to 204*d* is detachably installed in the printer body.

A laser exposure unit 203 that emits a laser beam to the photoconductive drum in each color photosensitive element unit to form an image is located above the imaging apparatus.

A conveyor belt 213 is positioned under the transfer belt 208. The conveyor belt 213 transfers the image on the transfer belt 208 onto paper. The image-transferred paper (transfer sheet) is fed to a fixing unit 214 by the conveyor belt 213. A double-side driving unit, which works as a sheet inverting unit, that inverses paper immediately after image formation on the top side of the paper to record an image on the back side thereof is provided under the conveyor belt 213 and the fixing unit 214.

When a start switch is pressed, if a document is present in the ADF 120 (FIG. 1), it is fed onto the contact glass of the scanner 100, or if no document is present in the ADF 120, the scanner 100 is immediately driven to scan a document manually placed on the contact glass, and a first carriage and a second carriage in the scanner 100 are driven for scanning. Light is emitted on the contact glass from the light source on the first carriage, and reflected light from the document surface is reflected at a first mirror on the first carriage to be directed toward the second carriage, is reflected at a second mirror on the second carriage, and travels through an imaging lens to form an image on a charge coupled device (CCD) as a read sensor. Based on an image signal acquired by the read sensor, record data of colors Bk, Y, M, and C are generated.

When the start switch is pressed, the rotation of the transfer belt 208 starts, the individual units of the imaging apparatus start preparation for imaging, an imaging sequence for each color image starts, and an exposure laser beam modulated based on the record data of each color is projected on the photoconductive drum of each color. Accordingly, toner images of the individual colors are transferred, one on another, onto the transfer belt 208 as a single image through the color imaging processes. When the leading end of the toner image comes to the conveyor belt 213, paper is simultaneously fed to the conveyor belt 213 from a pair of registration rollers 212 at a timing when the leading end of the paper comes to the conveyor belt 213 at the same time as the entrance of the leading end of the toner image to the conveyor belt 213, and the toner image on the transfer belt 208 is transferred onto the paper. A voltage for transferring toners is applied to the transfer belt 208 by the transfer rollers 205*a* to 205*d*. The paper with the toner images transferred thereon is fed to the fixing unit 214 where the toner images are fixed on the paper.

One of paper feed rollers directly above paper feed trays (also called paper feed units or cassettes) 209 to 211 of the paper feed bank 35 is selectively rotated to feed sheets of paper from the multi-tier paper feed trays 209 to 211 of the paper feed bank 35. One of the sheets is separated by a separate roller to enter a conveyor roller unit arranged vertically, is fed upward to be led to a conveyor roller unit in the printer 200, abuts on the registration roller pair 212 in the conveyor roller unit, and is then fed to the conveyor belt 213 at the aforementioned timing. Sheets of paper can be placed on a manual feed tray at the right end and fed therefrom. When the user places sheets of paper on the manual feed tray, the printer 200 rotates the paper feed roller of the manual feed tray to separate one sheet on the manual feed tray and feed the sheet to a manual feed path, and causes the sheet to abut on the registration roller pair 212.

Paper to be discharged after being fixed by the fixing unit 214 is guided to a discharge roller by a selecting claw, and is stacked on a paper discharge tray (not shown). Alternatively, the paper is guided to the double-side driving unit, is inversed and led to the transfer position again to record an image on the back side of the paper, and is then discharged on the paper discharge tray by the discharge roller. The residual toner on the transfer belt 208 after image transfer is removed by the transfer-body cleaning unit (not shown) to be ready for image formation again.

As shown in FIG. 2, the process cartridges 204*a* to 204*d* are respectively attached to connection ports A to D at installation positions A to D. The process cartridges 204*a* to 204*d* are designed to be detachable in a way that each process cartridge is detached from the printer body as it is lifted upward (direction z) toward the write unit 203 and then pulled forward (direction x), and is attached to the printer body through the reverse procedures. The four process cartridges 204*a* to 204*d* (hereinafter, "color process cartridge") are arranged in line above the transfer belt 208. The transfer rollers 205*a* to 205*d* are arranged at positions facing the process cartridges 204*a* to 204*d* with the transfer belt 208 in between. The three transfer rollers 205*b* to 205*d* corresponding to the color process cartridges are supported by a support frame 206 to be unitized so that the transfer rollers 205*b* to 205*d* are driven as a whole to the transfer operation position and the retraction position by an electric motor 207 incorporating a decelerator. The transfer rollers 205*b* to 205*d* of the connecting/disconnecting unit (205*b* to 205*d*, 206, 207) abut on the transfer belt 208 when color printing is to be performed. In black printing, the transfer rollers 205*b* to 205*d* are driven to the retraction position apart from the transfer belt 208, and the transfer roller 205*a* alone abuts on the transfer belt 208. In black printing, the color process cartridges 204*b* to 204*d* are not driven. This brings about an advantage of avoiding an increase in driving load of the color process cartridges 204*b* to 204*d*, and reducing the frictional fatigue between the photosensitive element of each cartridge and the transfer belt 208/developing roller/cleaner blade as much as possible, thereby suppressing undesirable reduction in service life.

The transfer-roller connecting/disconnecting unit (205*b* to 205*d*, 206, 207) is unitized for the color process cartridges to restrain the cost increase. Accordingly, the black process cartridge 204*a* is arranged at one end of the group of the process cartridges 204*a* to 204*d*. Although the black process cartridge 204*a* is located at the upper most position with respect to the rotational direction of the transfer belt 208 in the example of FIG. 2, the process cartridge 204*a* can be arranged in the lower most position.

FIG. 3 depicts the system configuration of an image processing system of the copying machine shown in FIG. 1. In this system, the color scanner 100 including a reading unit 110, a sensor board unit SBU, and an image data output I/F 112 is connected to an image data interface controller CDIC (hereinafter, "CDIC") of an image processing apparatus ACP (hereinafter, "ACP"). The color printer 200 is connected to the ACP. The color printer 200 receives recorded image data at a write I/F 234 from an image data processor IPP (hereinafter, "IPP"), and prints out the image data with an imaging unit 235. The imaging unit 235 is shown in FIG. 2.

The ACP includes a parallel bus Pb, a memory access controller IMAC (hereinafter, "IMAC"), a memory module (hereinafter, "MEM") that is an image memory, a hard disk drive HDD (hereinafter, "HDD") that is a nonvolatile memory, a system controller 1, a random access memory (RAM) 4, a nonvolatile memory 5, a font read-only memory (ROM) 6, the CDIC, and the IPP. A facsimile control unit FCU (hereinafter, "FCU") is connected to the parallel bus Pb. The operation board 20 is connected to the system controller 1.

The reading unit 110 of the color scanner 100, which optically scans a document, photo-electrically converts reflected light of light irradiated on the document from the lamp using a CCD on the sensor board unit SBU (hereinafter, "SBU") to generate R, G, and B image signals, converts the R, G, and B image signals to red/green/blue (RGB) image data by an analog/digital (A/D) converter, performs shading correction on the RGB image data, and sends the resultant RGB image data to the CDIC via the output I/F 112. The RGB image data is multi-value image data (for example, consisting of 8 bits) representing multiple tones.

The CDIC transfers image data among the color scanner 100 (output I/F 112), the parallel bus Pb, and the IPP, and executes communications on image data between a process controller 131 and the system controller 1 that performs the general control of the ACP. A nonvolatile RAM (NVRAM) 232 is used as a work area for the process controller 131, and a ROM 233 stores an operation program or the like for the process controller 131.

The IMAC controls writing/reading of image data and control data with respect to the MEM and the HDD. The system controller 1 controls the operations of the components connected to the parallel bus Pb. The RAM 4 is used as a work area for the system controller 1, and the nonvolatile memory 5 stores an operation program or the like for the system controller 1.

The operation board 20 instructs processes to be executed by the ACP. For example, the operation board 20 inputs the type of a process (copying, facsimile transmission, image reading, printing or the like), and the number of sheets to be processed. Accordingly, image-data control information can be input.

The image data read by the reading unit 110 of the scanner 100 undergoes shading correction in the SBU of the scanner 100, then undergoes image processing of correcting reading distortion, such as under color removal, scanner gamma correction or filtering, in the IPP before being stored in the MEM or the HDD. In printing out image data in the MEM or the HDD, the RGB image signal is subjected to color conversion to a yellow/cyan/magenta/black (YMCK) signal, which is also subjected to image quality processing like a gradation process, such as printer gamma conversion, gradation conversion, dithering or error diffusion processing. The image data after image quality processing is transferred to the write I/F 234 from the IPP. The write I/F 234 performs laser control on the gradation-processed signal with pulse width modulation and power modulation. The image data is then sent to the imaging unit 235, which forms a reproduced image on the transfer sheet.

The IMAC performs access control of image data and the MEM or the HDD, mapping of print data in the personal computer PC (hereinafter, "PC") connected to the LAN, compression/expansion of the image data for effective use of the MEM and the HDD, under the control of the system controller 1.

The image data sent to the IMAC is stored in the MEM or the HDD after data compression, and the stored image data is read out as needed. The read image data is expanded to original image data, which is returned to the CDIC from the IMAC through the parallel bus Pb. After transfer to the IPP from the CDIC, the image data is output to the write I/F 234 and a reproduced image is formed on the transfer sheet by the imaging unit 235.

The functions of the digital multifunction machine are realized by bus control by the parallel bus Pb and the CDIC in the flow of image data. Facsimile transmission is executed as the read image data is subjected to image processing in the IPP, and is then transferred to the FCU via the CDIC and the parallel bus Pb. The FCU performs data conversion for the network, and sends the converted data as facsimile data to the public communication network PN. Facsimile reception is executed as follows, circuit data from the public communication network PN is converted to image data by the FCU and the image data is transferred to the IPP via the parallel bus Pb and the CDIC. In this case, no special image processing is executed, the image data is output from the write I/F 234 and a reproduced image is formed on the transfer sheet by the imaging unit 235.

Under a circumstance where a plurality of jobs, such as a copy function, facsimile transmission/reception function, and a printer output function, are operated in parallel, the allocation of the right to use the reading unit 110, the imaging unit 235 and the parallel bus Pb to the jobs is controlled by the system controller 1 and the process controller 131. The process controller 131 controls the flow of image data, and the system controller 1 controls the overall system and manages the activation of the resources. The functions of the digital multifunction machine are selected by the operation board 20, and the process contents, such as the copy function and the facsimile function, are set by the selective input from the operation board 20.

The system controller 1 and the process controller 131 communicate with each other via the parallel bus Pb, the CDIC and a serial bus Sb. Specifically, the system controller 1 and the process controller 131 communicate with each other as data format conversion for data interface between the parallel bus Pb and the serial bus Sb is executed in the CDIC.

Various bus interfaces, such as a parallel bus I/F 7, a serial bus I/F 9, a local bus I/F 3, and a network I/F 8, are connected to the IMAC. The system controller 1 is connected to the associated units via plural kinds of buses to keep the independency in the whole ACP.

The system controller 1 controls other functional units via the parallel bus Pb. The parallel bus Pb is used to transfer image data. The system controller 1 sends the IMAC an operation control command for storing image data in the MEM or the HDD. The operation control command is sent via the IMAC, the parallel bus 7 and the parallel bus Pb.

In response to the operation control command, image data is sent to the IMAC from the CDIC via the parallel bus Pb and the parallel bus I/F 7. The image data is then stored in the MEM or the HDD under the control of the IMAC.

On the other hand, when called for the printer function from the PC, the system controller 1 of the ACP functions as the printer controller, the network controller and the serial bus controller. In case of data transfer over the network B, the IMAC receives a print output request data or storage (save) request data over the network B via the network I/F 8. The request data (external command) over the network B is notified to the system controller 1. In response to a command from the system controller 1 acknowledging the request data, the IMAC transfers storage data, or receives and stores the data over the network B.

The print output request data from the PC is developed to image data by the system controller 1. The image data is developed in an area in the MEM. Font data needed for the development is acquired by referring to the font ROM 6 via the local bus I/F 3 and a local bus Rb. The local bus Rb connects the system controller 1 to the nonvolatile memory 5 and the RAM 4. As for the serial bus Sb, it also includes an interface for data transfer to and from the operation board 20 that is the operation section of the ACP, in addition to data transfer to and from an external serial port 2. The interface relates not only to print development data, but also communication to the system controller 1 via the IMAC to, for example, accept process procedures and display a system status. Data transmission and reception among the system controller 1, the MEM, the HDD, and various buses are executed via the IMAC. Jobs that use the MEM and the HDD are uniformly managed in the whole ACP.

The process controller 131 controls the ON/OFF operations of the drive elements of the image-forming mechanism of the imaging unit 235 (FIG. 2) via an interface (I/F) 236, fetches detection signals from various sensors of the individual sections to determine the status of the imaging unit 235, and controls the operation and the imaging process conditions of the imaging unit 235. That is, the process controller 131 controls the imaging process.

Figure 4:
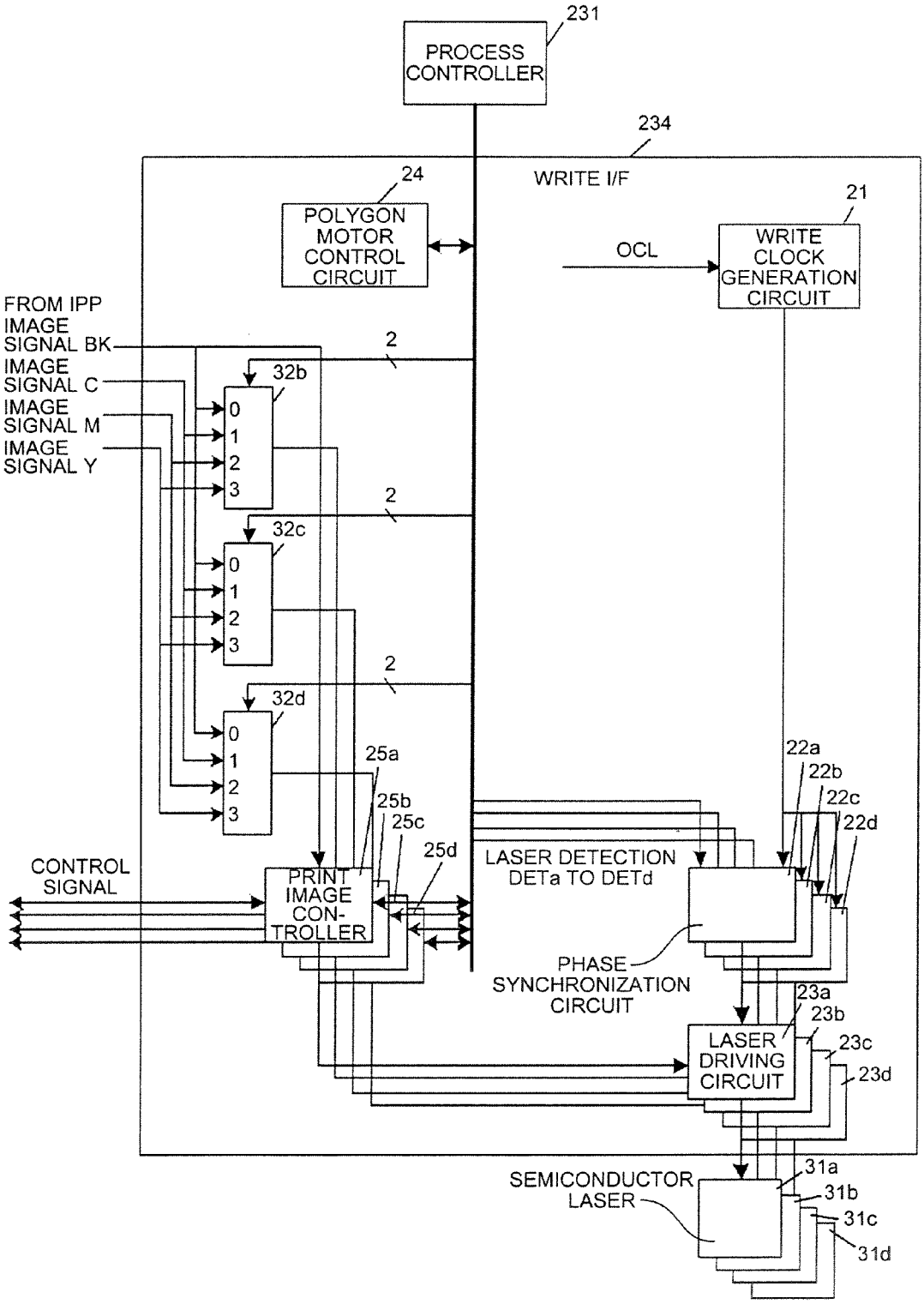
FIG. 4 is a block diagram of a write interface (I/F) shown in FIG. 3.

FIG. 4 depicts a configuration of the write I/F 234 of the color printer 200. Print image controllers 25*a* to 25*d* for color image signals of the magenta M, cyan C, yellow Y, and black Bk generally control the write I/F 234 in response to a command from a CPU of a process controller 231. Among the image signals M, C, Y, and Bk output from the IPP shown in FIG. 3, the image signal Bk is directly given to the print image controller 25*a* for outputting a black image, however, those of the image signals M, C, Y, and Bk that are selected by selectors 32*b* to 32*d* are supplied to the print image controllers 25*b* to 25*d*. The process controller 231 sends color designation data to specify which color image signals the selectors 32*b* to 32*d* are to select. Color designation data representing "0" in the decimal notation designates selection of Bk, color designation data representing "1" in the decimal notation designates selection of C, color designation data representing "2" in the decimal notation designates selection of M, and color designation data representing "3" in the decimal notation designates selection of Y.

The print image controllers 25*a* to 25*d* transfer supplied image signals to laser driving circuits 23*a* to 23*d*, respectively. A write clock generation circuit 21 sends phase synchronization circuits 22*a* to 22*d* an original clock OCL of a higher frequency than the frequency of a clock CLK of a cycle for each main scanning pixel. The phase synchronization circuits 22*a* to 22*d* are supplied with laser detection signals for forming color images, separated from the laser detection signal from a line synchronization detecting sensor located in the optical write unit 203 through a signal separation process, and a clock acquired by frequency-dividing the original clock OCL by the write clock generation circuit 21. Based on the laser detection signals and the frequency-divided clock, the phase synchronization circuits 22*a* to 22*d* generate frame gate signals for recording individual colors, a line synchronization signal and a pixel synchronization pulse that make the color recording positions on the paper identical in the main scanning direction x, and sends them to the laser driving circuits 23*a* to 23*d*. The laser driving circuits 23*a* to 23*d* separate the lines and pixels in synchronism with those signals, and control the activation of semiconductor lasers 31a to 31*d* for imaging exposure in the optical write unit 203 based on the color image signals output from the print image controllers 25*a* to 25*d*. That is, the laser driving circuits 23*a* to 23*d* turn on or off the laser beams, or modulate the laser beams. The semiconductor lasers 31*a* to 31*d* expose (write) the photosensitive elements in the process cartridges 204*a* to 204*d* connected to the connection ports A to D.

Figure 5:
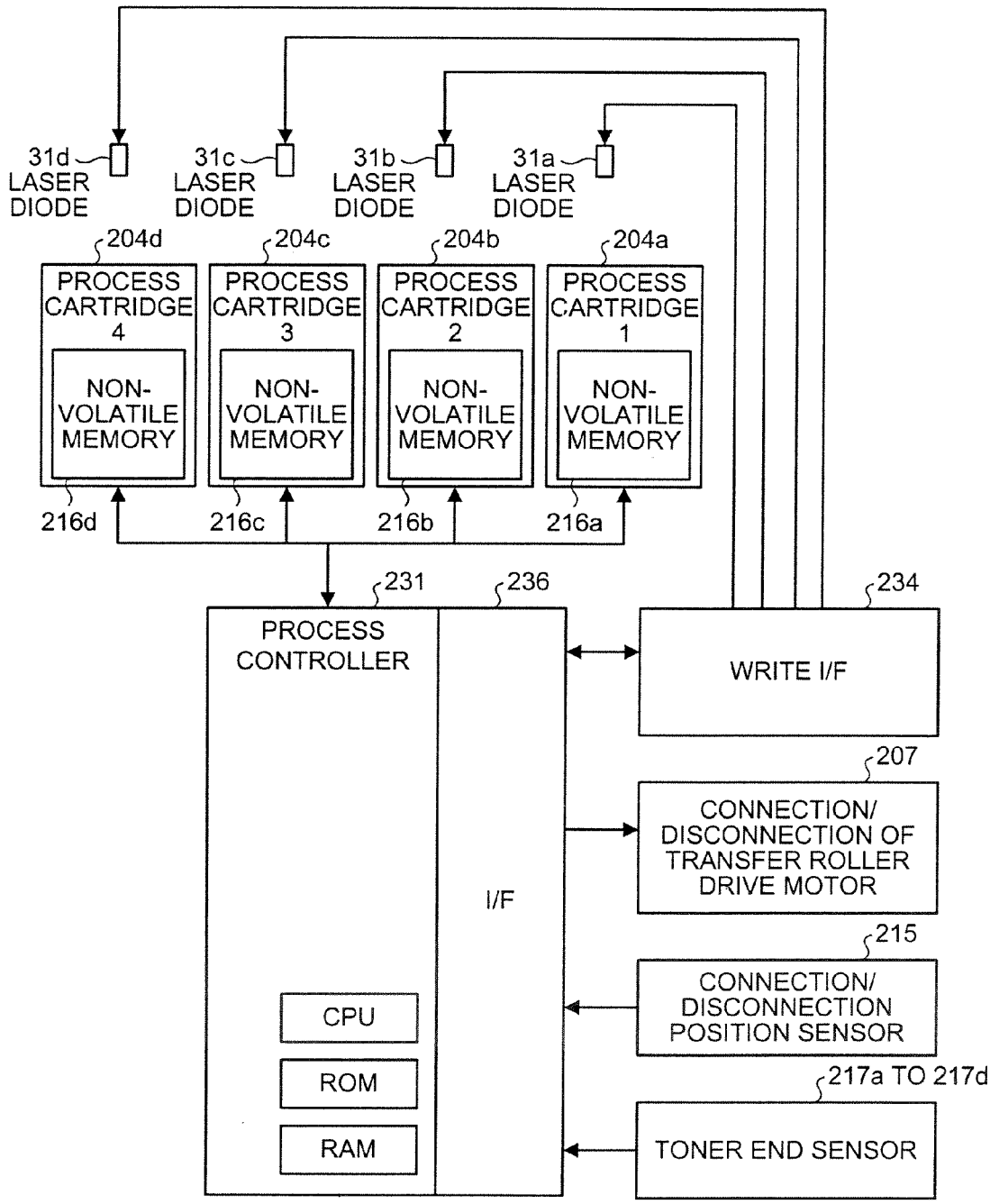
FIG. 5 is a block diagram of a system configuration in the image processing system shown in FIG. 3.

FIG. 5 simply depicts the system shown in FIG. 3 that controls imaging by the process cartridges 204*a* to 204*d* shown in FIG. 2. The process controller 231 serves to control the operation of the engine of the laser printer, and includes a ROM to store a contrcl program, a RAM to store data and operation results, and a CPU that executes the control program. Memory areas (hereinafter, "registers RPa to RPd") that store color information of toners corresponding to the positions A to D (ports A to D) where the process cartridges 204*a* to 204*d* are installed are predetermined in the RAM. The process cartridges 204*a* to 204*d* respectively have nonvolatile memories 216*a* to 216*d*each of which stores management data, such as the number of printouts, besides information on the imaging colors (toner colors) of the cartridges. The management data is used in determining the remaining service life.

The CPU of the process controller 231 reads stored data from tke nonvolatile memories 216*a* to 216*d* of the process cartridges 204*a* to 204*d* attached to the connection ports A to D using a communication unit (not shown), and stores the data in the registers RPa to RPd. A connection/disconnection position sensor 215 (also shown in FIG. 2) detects the position of the transfer-roller support frame 206, and is so designed as to shield the light to enable the output using a photo-interrupter when the support frame 206 is at the transfer operation position and to be in a transmissive state to disable the output when the support frame 206 is at the retraction position. In driving the support frame 206 to the transfer operation position, the motor 207 is activated, and is deactivated when the output of the sensor is enabled. In driving the support frame 206 to the retraction position, the motor 207 is stopped when the output of the sensor is disabled. Toner end sensors 217*a* to 217*d* are mounted on the respective process cartridges, and send toner statuses that indicate the presence or absence of the toners to the process controller 231.

Figure 6:
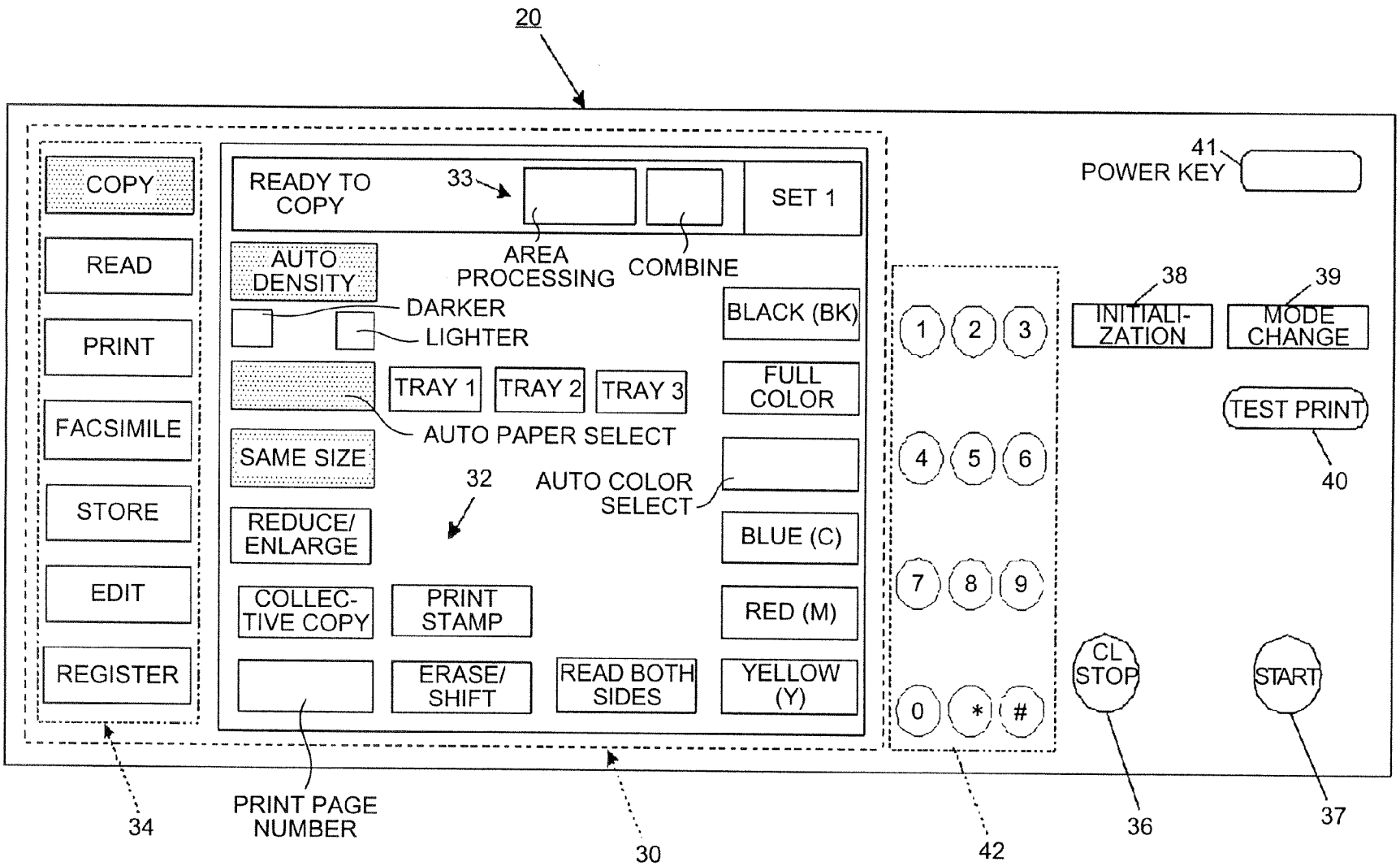
FIG. 6 is a plan view of an operation board shown in FIG. 3.

As shown in FIG. 6, the operation board 20 includes a numeric keypad 42, a clear/stop key 36, a start key 37, an initialization key 38, a mode change key 39, a test print key 40, and a power key 41 in addition to a liquid crystal touch panel 30. Although not shown, an alphabet keyboard with hiragana characters thereon is provided on the left side of the liquid crystal touch panel 30 to input URLs, e-mail texts, file names, folder names or the like, to make settings, and to register abbreviated telephone numbers.

The power key 41 is operated to instruct transition from a power-save mode (pause mode or low-power mode) to a standby mode that enables image printing, or vice versa. When the power key 41 is pressed once in power-save mode, the power-save mode is shifted to the standby mode. When the power key 41 is pressed once in standby mode, the standby mode is shifted to the pause mode. The test print key 40 is operated to print one printout regardless of the set number of printouts and check the printing result.

Pressing the initialization key 38 ensures arbitrary customization of the initial state of the copying machine. The initialization key 38 can set the transition time to the power-save mode, set the size of paper stored in the machine, and arbitrarily set a status that is set when a reset key for the copy function is pressed. As the initialization key 38 is pressed, a selection button for specifying the "initial value setting" function for setting various initial values, the "ID setting" function, the "copy-right registration/setting" function, the "use record output" function, etc. is displayed.

Various function keys, and messages representing operational statuses of the scanner 100, the printer 200 and the ACP are displayed on the liquid crystal touch panel 30. A function selection key 34 that ensures selection among the "copy" function, the "scanner" function, the "print" function, the "facsimile" function, the "storage" function, the "edition" function, the "registration" function, and other functions, and indicates any one of the functions in progress, is displayed on the liquid crystal touch panel 30. An input and output screen specific to the function designated by the function selection key 34 is displayed. When the "copy" function is designated, for example, the function keys, and messages 32 and 33 indicating the number of printouts, and the status of the image forming apparatus are displayed. When the operator touches a key displayed on the liquid crystal touch panel 30, the operation board 20 fetches the operation as an operator input, and displays in reverse the key indicating the selected function in gray, which represents designation in progress. When the details of the function (for example, the type or the like of page print) need to be designated, by touching the key, a pop-up menu of setting screen for the detailed function is displayed. Since the liquid crystal touch panel 30 is used as a dot display, the optimal display for that time can be presented graphically.

The function keys 32 include print color designation keys "black (Bk)", "full color", "auto color selection", "blue (C)", "red (M)" and "yellow (Y)".

Figure 7:
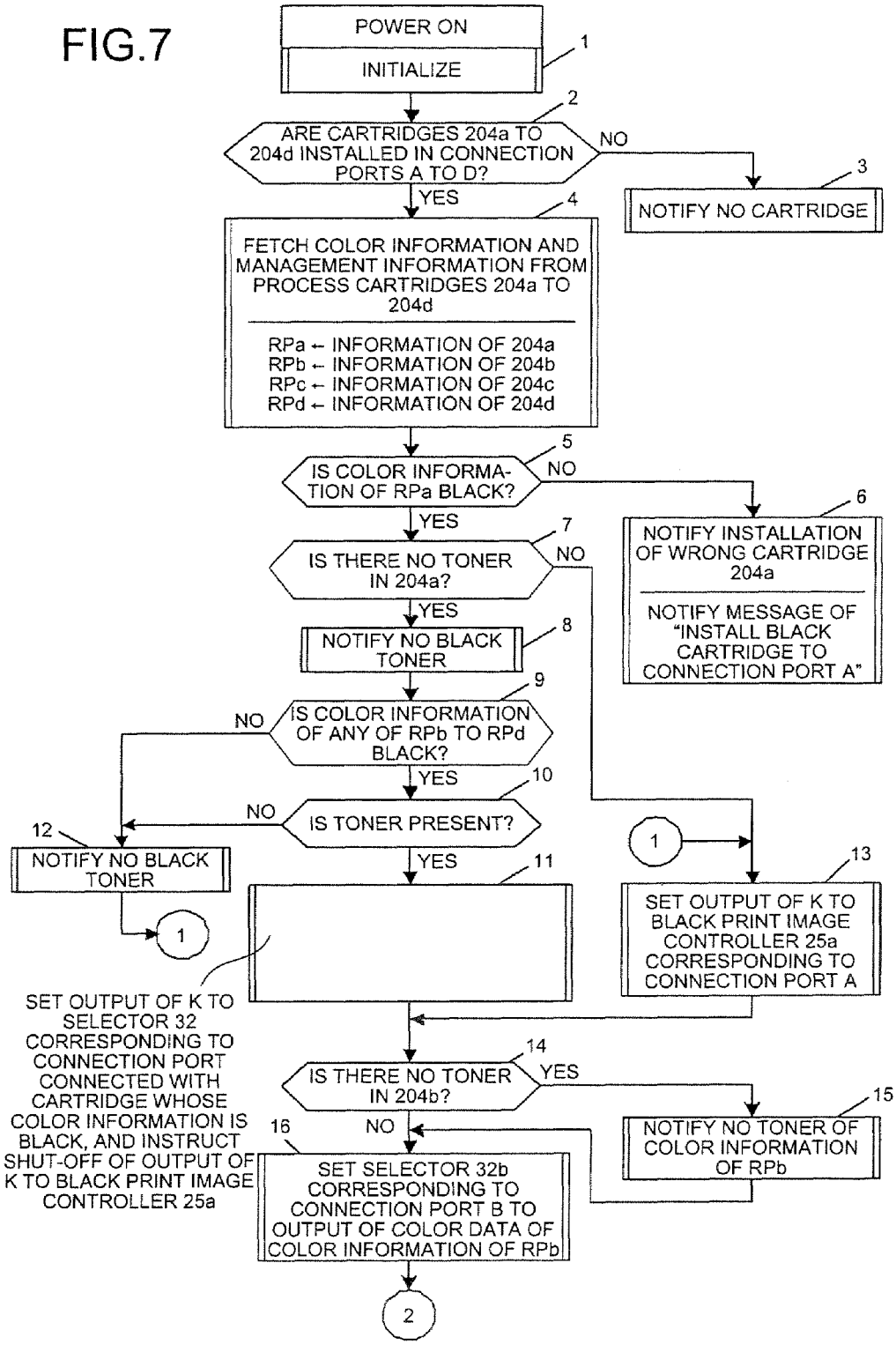
FIG. 7 is a flowchart of a part of an imaging process control by a process controller shown in FIGS. 3 and 5.

FIG. 7 depicts an outline of the portion of the imaging process control by the (CPU of the) process controller 231 that relates to this embodiment. When an operation voltage is applied, the process controller 231 executes initialization (step 1). The process controller 231 then detects whether cartridges are installed in all of the cartridge connection ports A to D. Specifically, when the process controller 231 sends a monitor signal to each of the connection ports A to D and receives a corresponding return signal (or acknowledgement of the monitor signal), the process controller 231 determines that there is a cartridge (step 2). When there is no cartridge installed in any of the connection ports A to D, the process controller 231 displays the absence of a cartridge and the necessity of installing a cartridge on the liquid crystal touch panel 30 (step 3). When cartridges are installed in all of the connection ports A to D, the process controller 231 reads color information and management information of the nonvolatile memories 216*a* to 216*d* of the process cartridges 204*a* to 204*d*, and writes those information in the registers RPa to RPd (step 4).

In the following explanations, the word "step" is omitted in parenthesis, and only the number of the corresponding step is indicated.

Next, the process controller 231 determines from the color information in the register RPa whether the imaging color of the process cartridge 204*a* is black. When the imaging color is not black, the process controller 231 displays the fact of installing the cartridge 204*a* of a wrong color to the port A on the liquid crystal touch panel 30 of the operation board 20, and displays a suggestion of installing a black cartridge in the connection port A (6).

When the imaging color of the cartridge 204*a* connected to the connection port A is black, the process controller 231 refers to the detection signal from the toner end sensor 217*a*, identifies if the cartridge 204*a* is in a toner end state, and, if it is not the toner end state, the process controller 231 sets outputting of black (Bk) print data (Bk printing) to the print image controller 25*a* shown in FIG. 4 (13). When it is the toner end state, the process controller 231 displays the absence of the black toner on the liquid crystal touch panel 30 of the operation board 20 (7 and 8). The process controller 231 refers to the color information of the other process cartridges 204*b* to 204*d* (9). When any piece of the color information indicates black imaging, the process controller 231 refers to the detection signal of the toner end sensor (one of 217*b* to 217*d*) mounted on the process cartridge, and if the process cartridge is not in a toner end state, the process controller 231 gives selective output support data of Bk to the selector (32*b*) that is assigned to the process cartridge (for example, 204*b*: the connection port B), sets the print data output to the print image controller (25*b*) that receives the print data (Bk) from the selector, and instructs the print image controller 25*a* corresponding to the connection port A to shut off the output of the print data (11). Even when the cartridges connected to the connection ports B to D include any cartridge associated with black imaging, if the cartridge is in a toner end state (the connection port to which the cartridge is connected), a message of the toner end is displayed on the liquid crystal touch panel 30 of the operation board 20 (12). In this case, the print image controller 25*a* corresponding to the connection port A is set to the output of the Bk print data (13).

The process controller 231 then refers to the detection signal from the toner end sensor 217*b* of the process cartridge 204*b* connected to the connection port B, and discriminates whether the process cartridge 204*b* is in a toner end state (14). When the process cartridge is not in a toner end state, the process controller 231 sets the output of print data of the imaging color of the process cartridge 204*b* (color information of PPb) to the selector 32*b* shown in FIG. 4. The output of print data (output of a formed image) is set to the print image controller 25*b*. It is to be noted that when the imaging color (color information of PPb) is black and the connection port A (process cartridge 204*a*) is not in a toner end state, shut-off of the output of print data (prohibition of imaging) is set to the print image controller 25*b* (16). When the process cartridge 204*b* is in a toner end state, the toner end state of the process cartridge 204*b* is displayed on the liquid crystal touch panel 30 of the operation board 20 (15).

With reference to FIG. 8, the process controller 231 refers to the detection signal from the toner end sensor 217*c* of the process cartridge 204*c* connected to the connection port C, and discriminates whether the process cartridge 204*c* is in a toner end state (17). When the process cartridge is not in a toner end state, the process controller 231 sets the output of print data of the imaging color of the process cartridge 204*c* (color information of PPc) to the selector 32*c* shown in FIG. 4. The output of print data (output of a formed image) is set to the print image controller 25*c*. It is to be noted that when the imaging color (color information of PPc) is black and the connection port A (process cartridge 204*a*) is not in a toner end state, shut-off of the output of print data (prohibition of imaging) is set to the print image controller 25*c* (19). When the process cartridge 204*c* is in a toner end state, the toner end state of the process cartridge 204*c* is displayed on the liquid crystal touch panel 30 of the operation board 20 (18).

The process controller 231 then refers to the detection signal from the toner end sensor 217*d* of the process cartridge 204*d* connected to the connection port D, and discriminates whether the process cartridge 204*d* is in a toner end state (20). When the process cartridge is not in a toner end state, the process controller 231 sets the output of print data of the imaging color of the process cartridge 204*d* (color information of PPd) to the selector 32*d* shown in FIG. 4. The output of print data (output of a formed image) is set to the print image controller 25*d*. It is to be noted that when the imaging color (color information of PPd) is black and the connection port A (process cartridge 204*a*) is not in a toner end state, shut-off of the output of print data (prohibition of imaging) is set to the print image controller 25*d* (23). When the process cartridge 204*d* is in a toner end state, the toner end state of the process cartridge 204*d* is displayed on the liquid crystal touch panel 30 of the operation board 20 (22).

When all of the imaging colors of the process cartridges 204*a* to 204*d* connected to the connection ports A to D differ from one another, the process controller 231 writes "1" to a register Fsac, and when the imaging colors of two or more of the process cartridges 204*a* to 204*d* are identical, the process controller 231 writes "0" in the register Fsac (24 to 26).

When there is a print start command, the process controller 231 executes "print" (28). The contents of the "print" (28) will be explained with reference to FIG. 9. When there is a copy start command, the process controller 231 executes "copy", and the imaging process control by the process controller 231 in the copying is the same as that of the "print" (28) to be explained below.

Figure 9:
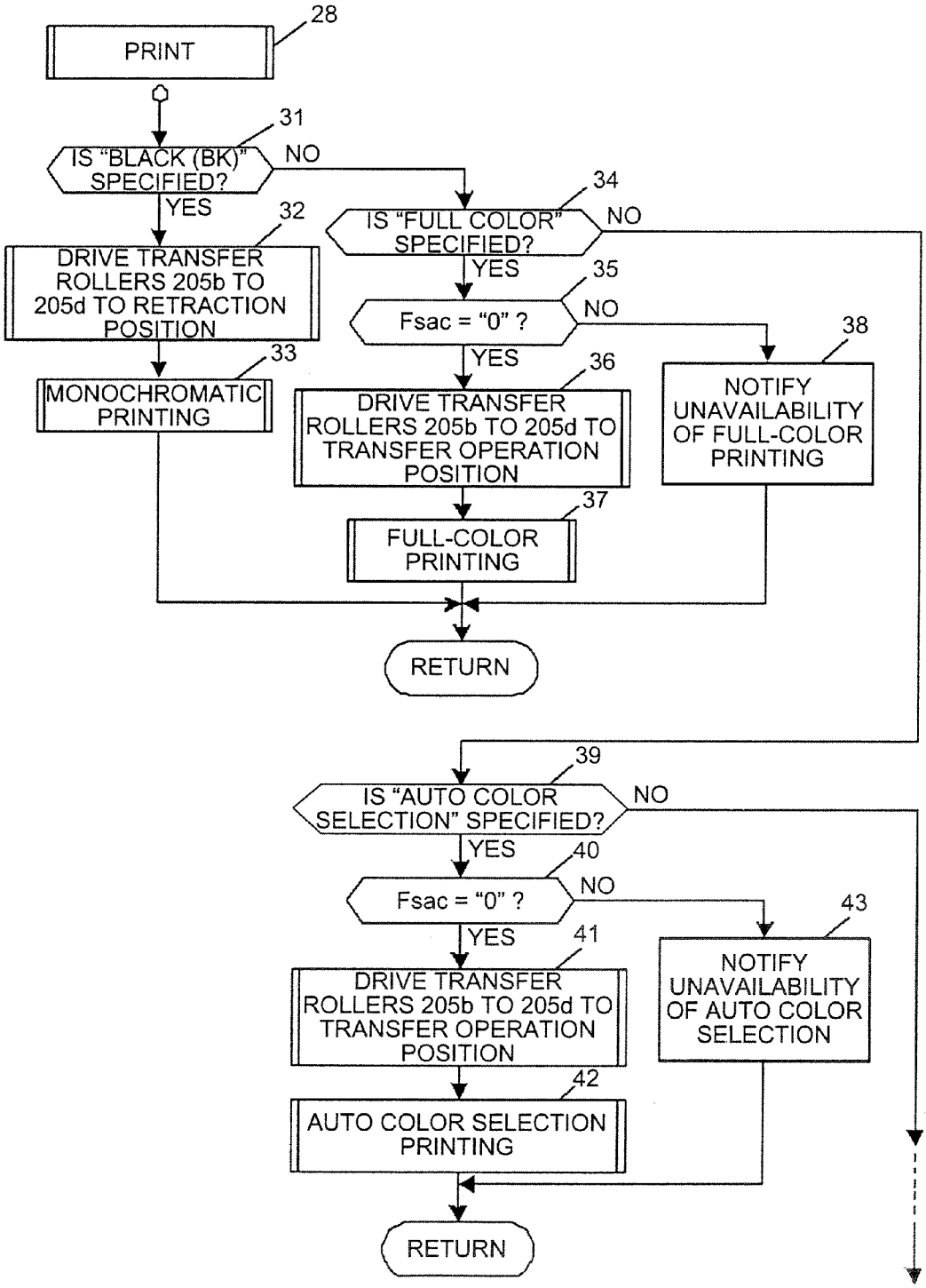
FIG. 9 is a flowchart of a print process shown in FIG. 8.

With reference to FIG. 9, when "black (Bk)" printing (monochromatic printing) is designated by the user's touch corresponding to the "black (Bk)" button (FIG. 6), the process controller 231 refers to the detection signal from the connection/disconnection position sensor 215 (FIGS. 2 and 5), reversely rotates the motor 207 (FIG. 2) when the detection signal represents the "transfer operation position", and stops the motor 207 when the detection signal from the connection/disconnection position sensor 215 represents the "retraction position" (31 and 32). The process controller 231 then starts the imaging process control of "monochromatic print" (33).

If "full color" printing is designated by the user's touch corresponding to the "full color" button (FIG. 6) when the operation flow goes to "print" (28), the process controller 231 refers to the data of the register Fsac (34 and 35). When the data of the register Fsac is "1" (the imaging colors of two or more cartridges are identical), an error-print originated from insufficient display colors can occur, so that an alarm message representing unavailability of full-color printing is displayed on the liquid crystal touch panel 30 of the operation board 20 (38), and the flow does not proceed to print control. That is, the process controller 231 suspends the initiation of the print process control and does not execute full-color printing.

When the data of the register Fsac is "0" (the imaging colors of all of the cartridges 204*a* to 204*d* differ from one another; imaging of the colors Y, M, C, and Bk is possible), the process controller 231 refers to the detection signal from the connection/disconnection position sensor 215, forwardly rotates the motor 207 when the detection signal represents the "retraction position", and stops the motor 207 when the detection signal from the connection/disconnection position sensor 215 represents the "transfer operation position" (36). The process controller 231 then starts the imaging process control of "full-color print" (37).

If "auto color selection" printing is designated by the user's touch corresponding to the "auto color selection" button (FIG. 6) when the operation flow goes to "print" (28), the process controller 231 refers to the data of the register Fsac (39 and 40). When the data of the register Fsac is "1" (the imaging colors of two or more cartridges are identical), an error-print originated from insufficient display colors can occur, so that an alarm message representing the unavailability of auto color selection printing is displayed on the liquid crystal touch panel 30 of the operation board 20 (43), and the flow does not proceed to print control. That is, the process controller 231 suspends the initiation of the print process control and does not execute auto color selection printing.

When the data of the register Fsac is "0", the process controller 231 refers to the detection signal from the connection/disconnection position sensor 215, forwardly rotates the motor 207 when the detection signal represents the "retraction position", and stops the motor 207 when the detection signal from the connection/disconnection position sensor 215 represents the "transfer operation position" (41). The process controller 231 then starts the imaging process control of "auto color selection" (42).

Figure 10:
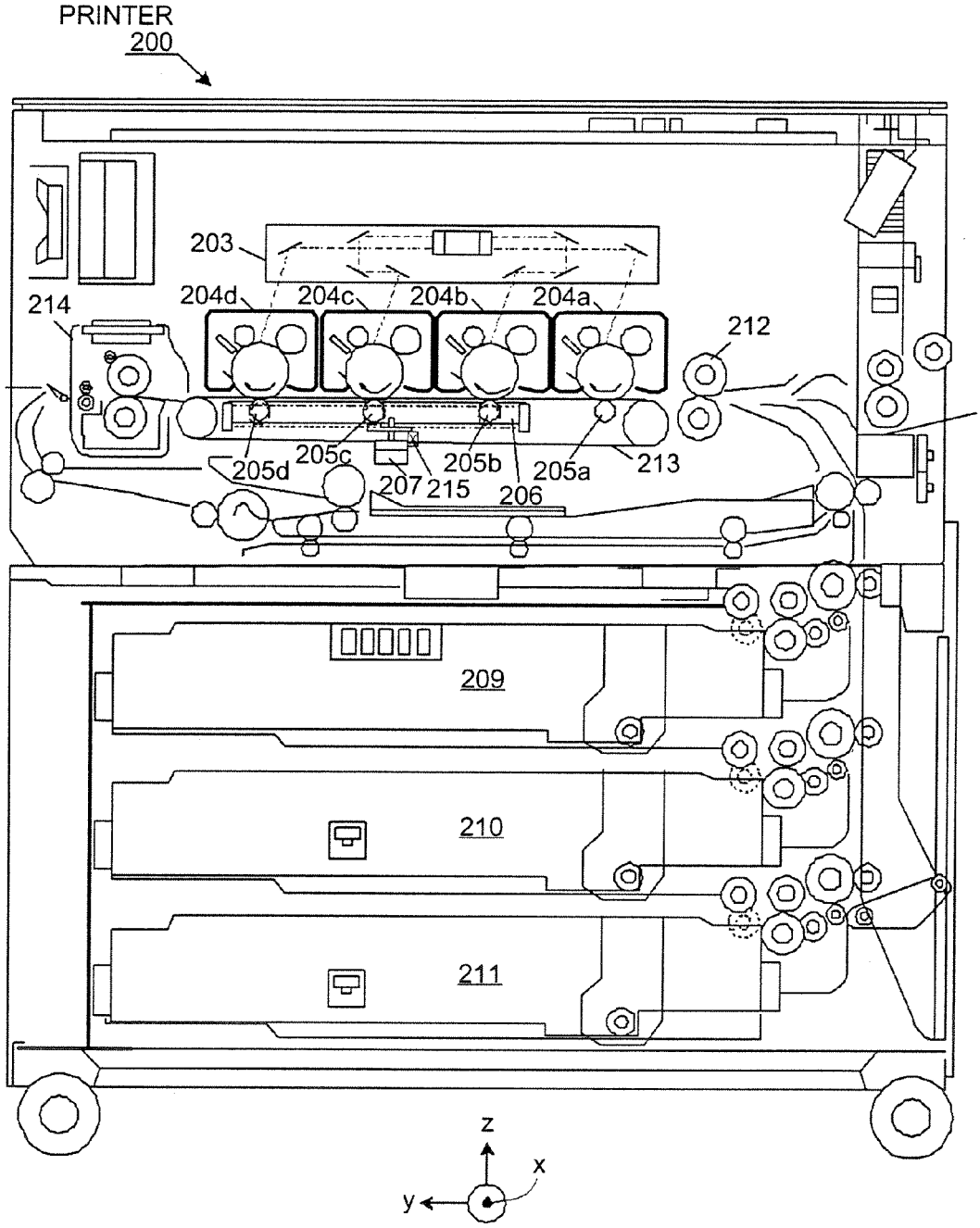
FIG. 10 is a cross-section of an image-forming mechanism of a printer of a multifunction full-color copying machine according to a second embodiment of the present invention.

FIG. 10 depicts a configuration of the printer 200 according to a second embodiment of the present invention. According to the second embodiment, the printer 200 directly transfers color images, formed on the respective photosensitive elements by the process cartridges 204*a* to 204*d*, on paper which is fed toward the fixing unit 214 while being carried on the conveyor belt 213 by the transfer rollers 205*a* to 205*d*. According to the first embodiment, the process cartridges 204*a* to 204*d* are arranged in tandem along the moving path of the transfer belt 208, color images, formed on the respective photosensitive elements by the process cartridges 204*a* to 204*d*, are transferred onto paper on the transfer belt 208 by the transfer rollers 205*a* to 205*d*, are then transferred from the transfer belt 208 onto the paper, and the paper on which image is transferred is fed to the fixing unit 214 by the conveyor belt 213. That is, the first embodiment is of an indirect transfer type which transfers images from the process cartridges 204*a* to 204*d* to paper via the transfer belt 208, whereas the second embodiment is of a direct transfer type in which the process cartridges 204*a* to 204*d* are arranged in tandem along the paper feed path of the conveyor belt 213, color images formed on the respective photosensitive elements by the process cartridges 204*a* to 204*d* are sequentially transferred onto the paper by the transfer rollers 205*a* to 205*d* while the paper is carried on and fed by the conveyor belt 213.

Configurations of parts other than the ones described above and all functions according to the second embodiment are identical to those of the multifunction copying machine MF1 according to the first embodiment described above and shown in FIGS. 1 to 9.

According to the embodiments described above, it is possible to arrange respective image-forming process cartridges at relatively arbitrary positions, thereby realizing desirable systemization of a user.

Moreover, according to the embodiments described above, it is possible to avoid an error-print.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that includes a plurality of image-forming process cartridges arranged in tandem, comprising:

a color-information acquiring unit configured to acquire color information representing a color of an image to be formed by each of the image-forming process cartridges;

an image-information distributing unit configured to distribute print information for the color to an image-forming process cartridge that forms an image of the color;

a designating unit configured to designate a print mode that includes a monochromatic mode and a full-color mode;

a control unit configured to control image forming operation by the image-forming process cartridges to perform a print operation in designated print mode; and an alarming unit configured to generate an alarm in response to the full-color mode being designated by the designating unit when the color is identical in two or more image-forming process cartridges.

2. The image forming apparatus according to claim 1, wherein the control unit is configured to suspend the print operation in the full-color mode when the color is identical in two or more image-forming process cartridges.

3. The image forming apparatus according to claim 1, wherein the print mode further includes an auto-color mode, and the alarming unit is configured to generate an alarm for designation for the auto color mode when the color is identical in two or more image-forming process cartridges.

4. The image forming apparatus according to claim 3, wherein the control unit is configured to suspend the print operation in the auto-color mode when the color is identical in two or more image-forming process cartridges.

5. The image forming apparatus according to claim 1, wherein the alarming unit is configured to notify a cartridge installation error when a color of an image to be formed by an image-forming process cartridge that is positioned at an end in an arrangement of the image-forming process cartridges differs from a specific monochromatic color.

6. The image forming apparatus according to claim 5, wherein number of an installation position at which the image-forming process cartridge is installed is four, and the specific monochromatic color includes black.

7. The image forming apparatus according to claim 5, further comprising a detector configured to detect shortage of developer in each of the image-forming process cartridges, wherein when the detector detects the shortage in the image-forming process cartridge positioned at the end, and when an image-forming process cartridge positioned at a different position has color information of a color identical to the color of the developer of which the shortage is detected, the control unit is configured to cause the image-information distributing unit to distribute print information for the color of the developer of which the shortage is detected, to the image-forming process cartridge having the color information of the color identical to the color of the developer of which the shortage is detected.

8. The image forming apparatus according to claim 7, wherein the image-information distributing unit includes a signal selecting unit configured to selectively outputs print information having a plural pieces of color information to image-forming process cartridges positioned at a different position, and the control unit is configured to control the signal selecting unit to output print information corresponding to the color of an image to be formed by each of the image-forming process cartridge.

9. The image forming apparatus according to claim 8, wherein the different position includes three positions, and the signal selecting unit includes three selectors each of which selectively outputs print information of one of yellow, magenta, cyan, and black, and respectively assigned to each of the three positions.

10. The image forming apparatus according to claim 8, wherein print information of the specific monochromatic color is output to the image-forming process cartridge positioned at the end without using the signal selecting unit.

11. The image forming apparatus according to claim 1, further comprising:

a transfer unit configured to transfer an image formed by each of the image-forming process cartridges to any one of an intermediate transfer body and paper; and a laser writing unit configured to emit laser beams modulated according to print information, wherein each of the image-forming process cartridges includes an electrophotographic imaging unit including a photosensitive element;

a charging unit configured to charge a surface of the photosensitive element; and a developing unit configured to develop an electrostatic latent image formed on charged surface with a developer, and the laser writing unit is configured to emit modulated laser beams to the charged surface of the photosensitive element of each of the image-forming process cartridges.

12. The image forming apparatus according to claim 11, wherein the image-forming process cartridges are arranged in tandem along the intermediate transfer body, and the image formed by each of the image-forming process cartridges is transferred to the intermediate transfer body by the transfer unit, and then, transferred onto paper from the intermediate transfer body.

13. The image forming apparatus according to claim 11, further comprising a driving unit configured to drive the transfer unit in at least one image-forming process cartridge excluding the image-forming process cartridge positioned at the end, to a retraction position shifted from a transfer position at which a transfer operation is performed, wherein the transfer unit in at least one image-forming process cartridge other than the image-forming process cartridge positioned at the end is positioned at the retraction position during a print operation in such a print mode that only the image-forming process cartridge positioned at the end is used.

14. The image forming apparatus according to claim 13, wherein the transfer unit in the image-forming process cartridge other than the image-forming process cartridge positioned at the end is supported by a common support frame, and the driving unit is configured to drive the support frame between the transfer position and the retraction position.

15. The image forming apparatus according to claim 1, wherein each of the image-forming process cartridges includes a nonvolatile memory configured to store the color information, and the color-information acquiring unit is configured to acquire the color information by reading from the nonvolatile memory.

* * * * *